US006354629B1

(12) United States Patent
McNeal et al.

(10) Patent No.: US 6,354,629 B1
(45) Date of Patent: Mar. 12, 2002

(54) ADJUSTABLE LENGTH SPORT POLE AND COUPLING MECHANISM

(75) Inventors: Joseph R. McNeal, Hailey, ID (US); Michael K. Reeves, Woodinville, WA (US); Aaron K. Taylor, Hailey, ID (US)

(73) Assignee: Smith Sport Optics, Incorporated, Ketchum, ID (US)

( * ) Notice: Subject to any disclaimer, the term of this patent is extended or adjusted under 35 U.S.C. 154(b) by 0 days.

(21) Appl. No.: 09/014,632

(22) Filed: Jan. 28, 1998

(51) Int. Cl.[7] ..... A63C 11/22

(52) U.S. Cl. ..... 280/823; 280/820; 135/75; 403/112; 403/377

(58) Field of Search ..... 280/823, 819, 280/820; 135/75, 65; 403/112, 377, 379.6, 379.1, 302, 305, 308

(56) References Cited

U.S. PATENT DOCUMENTS

| | | | | | |
|---|---|---|---|---|---|
| 3,722,903 | A | * | 3/1973 | Jones | 280/823 |
| 4,288,102 | A | * | 9/1981 | Ramer | 280/823 |
| 4,596,405 | A | * | 6/1986 | Jones | 280/823 |
| 5,320,348 | A | * | 6/1994 | Starrett | 135/75 |
| 5,433,551 | A | * | 7/1995 | Gordon | 403/377 |
| 5,538,354 | A | * | 7/1996 | Simond | 280/823 |
| 5,593,239 | A | * | 1/1997 | Sallee | 403/377 |

FOREIGN PATENT DOCUMENTS

| | | | | |
|---|---|---|---|---|
| CH | 416411 | * | 1/1967 | 280/823 |

* cited by examiner

*Primary Examiner*—Lanna Mai
*Assistant Examiner*—Lynda Jasmin
(74) *Attorney, Agent, or Firm*—Dorsey & Whitney LLP

(57) ABSTRACT

An adjustable length sport pole and coupling mechanism is shown and described. In one embodiment, the sport pole has a first pole assembly having a first pole and a sleeve, a second pole slidably received within the first pole assembly and a locking assembly. The second pole may have an outer surface with detents at defined locations along the pole axis. The locking assembly has a resilient locking element configured to contact and extend around an exterior portion of the second pole, and a collar movably coupled to the first pole assembly to move between a lock position and a release position. The resilient locking element extends around the second pole, and the locking element is configured so that it expands when it is attached to the second pole. The resilient locking element accordingly presses against the second pole. The collar has a retaining surface that aligns with the locking element in the lock position to hold the locking element in one of the detents to prevent axial movement between the first and second poles. The collar also has a recessed surface that aligns with the locking element in the release position to allow the locking element to disengage from the detent for permitting axial movement between the first and second poles.

53 Claims, 6 Drawing Sheets

ADJUSTABLE LENGTH SPORT POLE AND COUPLING MECHANISM

TECHNICAL FIELD

The present invention relates to adjustable length sport poles for use in hiking, skiing and other outdoor recreational activities, and to coupling mechanisms that may be used in sport poles.

BACKGROUND OF THE INVENTION

In many outdoor recreational activities, such as skiing and hiking, poles are used for better balance and performance. Skiers, for example, plant ski-poles in the snow to execute turns, maintain their balance, or push-off over flat terrain. Hikers use similar poles to enhance their stability over rough or slippery terrain. Conventional ski-poles are widely used in both alpine and nordic skiing, and hiking-poles are becoming very popular for all levels of hiking.

Ski-poles and hiking-poles are very similar, but they typically have different lengths to accommodate the particular requirements of the different activities. Alpine ski-poles are typically quite long because alpine skiers plant the poles in front of them down the slope of the hill. Hiking-poles, on the other hand, are typically shorter than ski-poles because hikers prefer to have shorter poles for going uphill and hikers generally do not hike down the fall line of steep slopes. Hikers, however, may also prefer to have longer poles for going downhill, or to have one short pole and one long pole for going laterally across sloped hillsides. Also, because hiking-poles may need to be stored during a hike (e.g., while climbing), it is also desirable to fit hiking-poles into a backpack. Thus, to meet the different requirements for ski-poles and hiking-poles with a single pole, it is desirable to adjust the length of the poles.

Conventional adjustable length poles typically have two or three telescoping pole sections with a device to releasably fix one section to an adjoining section. In one conventional pole, an inner pole section is fixed to an outer pole section with an exterior clamp. Such clamps, for example, are permanently attached to the outer pole sections to contract and frictionally engage the smooth outer surface of the inner pole sections. Typical exterior pole clamps are similar to those used on bicycle stems for adjusting the height of bicycle seats. In another conventional adjustable length pole, inner and outer pole sections are fixed together with a locking device having a wedge and an expandable member attached to an end of the inner pole section. The wedge and the expandable member are received in the outer pole section, and the wedge is positioned in the expandable member to distend the expandable member. These locking devices operate by rotating the inner and outer pole sections with respect to one another to drive the wedge into the expandable member. As the wedge drives into the expandable member, the wedge distends the expandable member to press against the inner surface of the outer pole section until the friction between the expandable member and the outer pole section holds the inner and outer pole sections together.

Although conventional adjustable poles are useful for skiing and hiking, the conventional clamp-type and expandable member-type locking assemblies often allow the inner and outer pole sections to slip with respect to one another when large axial loads are placed on the pole. Unfortunately, the largest axial loads are typically placed on the pole when a skier or a hiker is falling, and thus such slippage between the pole sections may render the poles less effective in supporting the user. Such slippage between the pole sections is also inconvenient because the poles may need to be readjusted back to a desired length. Efforts are often made to make adjustable length poles less prone to slipping by tightening the clamps or expandable members with greater force. However, doing so can make it difficult to release the clamps and the expandable members for adjustment, particularly if they are tightened too tight. Additionally, conventional adjustable length poles may be difficult to adjust to a definite length because the clamps and the expandable members may engage any portion of the particular pole section. Therefore, conventional adjustable length poles may have several drawbacks for use as ski-poles and hiking-poles.

SUMMARY OF THE INVENTION

The present invention is directed toward adjustable length sport poles and methods of using adjustable length sport poles in for skiing, hiking and other recreational activities. In one embodiment of the invention, an adjustable length sport pole has a first pole section, a second pole section slidably received within the first pole section, and a locking assembly to releasably hold the first and second pole sections together at defined positions.

The locking assembly for releasably coupling the first and second pole sections together has a resilient locking element and a collar that moves between a lock position and a release position with respect to the locking element. In one embodiment, the resilient locking element extends around the second pole section in a plane transverse to the pole axis, and the locking element has an inner dimension less than an outer dimension of the second pole section. The locking element accordingly expands when it is attached to the outer surface of the second pole section to press radially inward against the second pole section. As such, the locking element may snap into detents formed in the outer surface of the second pole section at defined locations along the length of the second pole section when one of the detents is aligned with the locking element.

The collar may have a cavity defined by a retaining surface and a recessed surface, and the locking element is positioned within the cavity. The retaining surface limits the expansion of the locking element when the collar is in the lock position and the locking element is in one of the detents. The retaining surface of the collar accordingly prevents the locking element from disengaging the detent and sliding over the second pole section to prevent axial movement between the first and second pole sections. When the collar is in the release position, the locking assembly allows axial movement between the first and second pole sections to adjust the length of the pole to another defined pole length.

In one particular embodiment, the first and second pole sections are first and second tubes, and the detents in the second pole section are annular grooves around the second tube. The locking element may accordingly be a clip, such as a C-spring or a ring-spring, with a curved inner surface to fit in the annular grooves and a flat outer surface to engage the retaining surface of the collar. Prior to being assembled with the second pole section, the inner diameter of the clip preferably is slightly smaller than the outer diameter of the second pole section so that the clip biases itself against the second pole section. In this embodiment, the clip releasably snaps into the detents as the second pole section moves axially along the first pole section during adjustment.

DETAILED DESCRIPTION OF THE INVENTION

The present invention is an adjustable length sport pole and a method for adjusting the length of sport poles used in hiking, skiing and other recreational activities. Many specific details of certain embodiments of the invention are set forth in the following description and in FIGS. 1–6B to provide a thorough understanding of such embodiments. One skilled in the art, however, will understand that the present invention may have additional embodiments and that other embodiments of the invention may be practiced without several of the details and components described in the following description.

Figure 1:
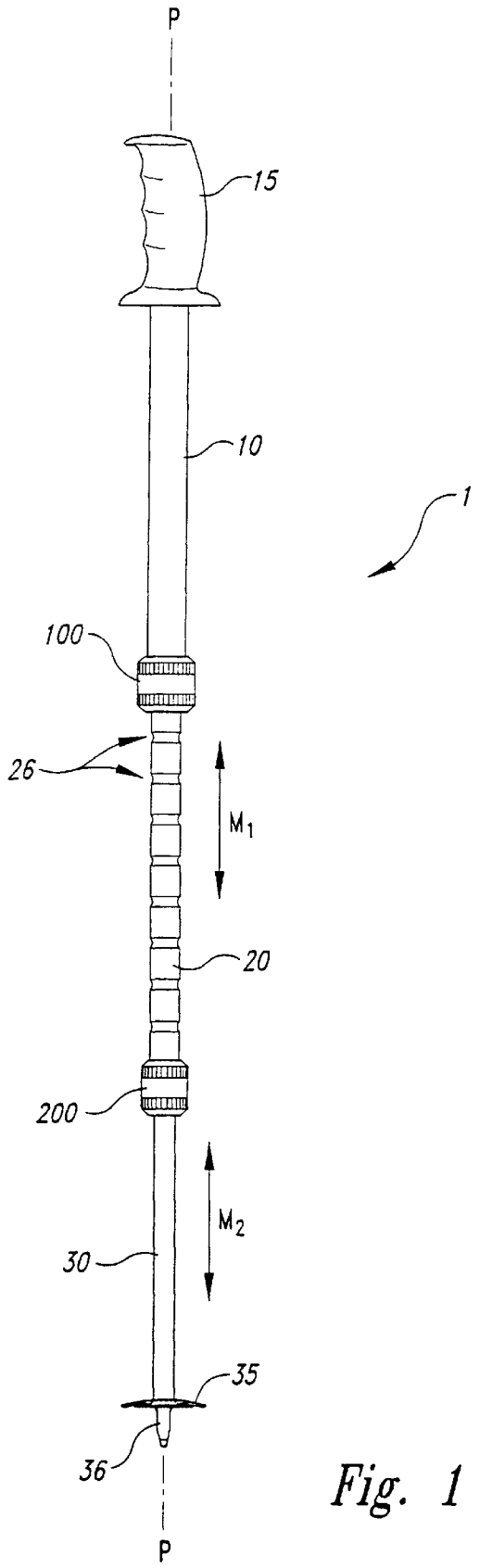
FIG. 1 is a side elevational view of an adjustable length sport pole in accordance with one embodiment of the invention.

FIG. 1 is a side elevational view of an adjustable length sport pole 1 in accordance with one embodiment of the invention. In this embodiment, the pole 1 has a first pole section 10, a second pole section 20 coupled to the first pole section 10 by a first locking assembly 100, and a third pole section 30 coupled to the second pole section 20 by a second locking assembly 200. The second pole section 20 slides within the first pole section 10 so that it may be moved along a pole axis P-P to extend out of or contract into the first pole section 10 (arrow $M_1$). The third pole section 30 similarly slides within the second pole section 20 along the pole axis P-P so that it may extend out of or contract into the second pole section 20 (arrow $M_2$). A handle 15 may be attached to the upper end of the first pole section 10, and a basket 35 and a tip 36 may be attached to the lower end of the third pole section 30. As explained in more detail below, the first locking assembly 100 releasably couples the first and second pole sections 10 and 20 together at defined locations, and the second locking assembly 200 releasably couples the second and third pole sections 20 and 30 together at either an extended or a contracted position.

Figure 2:
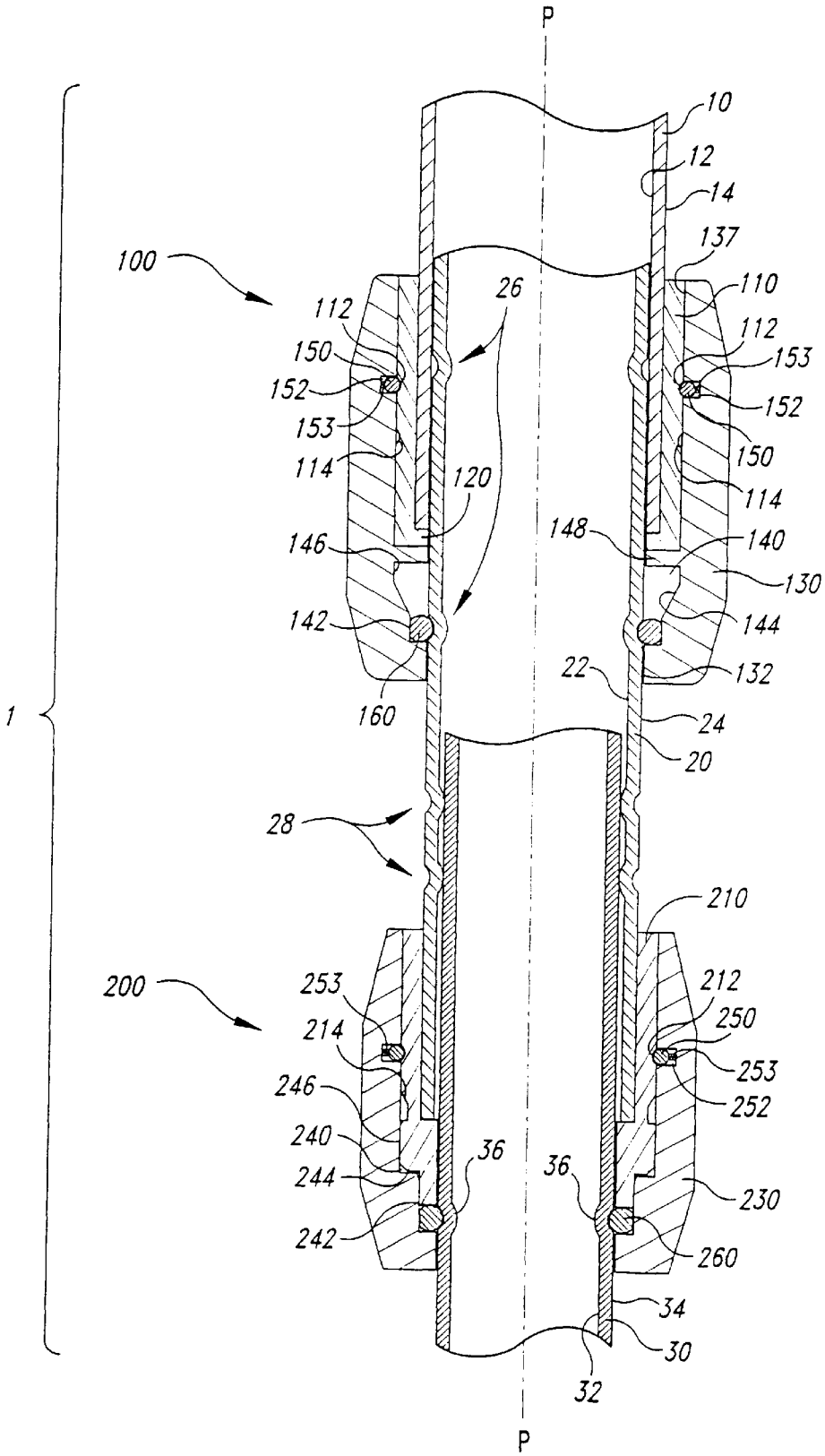
FIG. 2 is a partial cross-sectional view of an adjustable pole with first and second locking assemblies in accordance with an embodiment of the invention.

FIG. 2 is a partial cross-sectional view of the adjustable length pole 1 illustrating the relationship between the first and second locking assemblies 100 and 200, and the three pole sections 10, 20 and 30. The pole sections 10, 20 and 30 may be cylindrical tubes in which the first pole section 10 has the largest diameter, the second pole section 20 has an intermediate diameter that fits within the first pole section 10, and the third pole section 30 has the smallest diameter to fit within the second pole section 20. Although the clearance between an inner surface 12 of the first pole section 10 and an outer surface 24 of the second pole section 20 may vary, the diameter of the outer surface 24 is preferably approximately 0.001–0.050 inches less than the diameter of the inner surface 12. The second pole section 20 also has a plurality of detents 26 that may be annular grooves spaced apart from one another at increments along the length of the second pole section 20. In a particular embodiment, the detents are formed by rolling techniques known in the metal forming arts, and they are formed to a depth of approximately 0.005–0.050 inches. Two of the annular grooves may be grooves 28 at the lower end of the second pole section for holding the second pole section 20 in a completely contracted position. The detents 26 may extend around an exterior portion of the second pole section 20 in a plane transverse to the pole axis P-P (best shown in FIG. 1). The third pole section 30, accordingly, has an inner surface 32 and an outer surface 34 with a third diameter small enough to be received within the detents 26 and 28 of the second pole section 20. The third pole section 30 may also have a plurality of detents 36, such as annular grooves that extend around the third pole section 30.

In addition to the three pole sections shown in FIGS. 1 and 2, adjustable length poles in accordance with the invention may use as few as two pole sections or more than three pole sections. Additionally, pole sections with other cross-sectional shapes (e.g., rectangular or oval) may be used instead of cylindrical tubes. In light of the relationship between the three pole sections 10, 20 and 30, each of the first and second locking assemblies 100 and 200 will be described in detail in FIGS. 2–6B.

Still referring to FIG. 2, the first or upper locking assembly 100 has a sleeve 110 attached to the outer surface 14 of the first pole section 10, a collar 130 slidably coupled to the sleeve 110, and a resilient locking element 160 received within a cavity 140 of the collar 130. The sleeve 110 may also have a lip 120 abutting the end of the first pole section 10 to prevent the sleeve from slipping with respect to the first pole section 10 under large axial loads. The sleeve 110 may be attached to the first pole section 10 by welding, braising or other suitable techniques known to persons skilled in the art. The sleeve 110 may have a first depression 112 corresponding to a lock position for the collar 130 and a second depression 114 corresponding to a release position for the collar 130. The first and second depressions 112 and 114, for example, may be annular grooves extending around the sleeve 110.

The collar 130 has an opening 132 at one end to receive the second pole section 20 and a larger opening 137 at its other end to receive the sleeve 110. The cavity 140 in the lower portion of the collar 130 is defined by a retaining surface 142, a beveled surface 144 diverging from the retaining surface 142, and a recessed surface 146 spaced radially outward from the retaining surface 142. The collar 130 may also have a shoulder 148 projecting radially inward from the recessed surface 146 to approximately the diameter of the opening 132. As explained in further detail below, the retaining surface 142 retains the locking element 160 in a lock position in one of the detents 26 of the second pole section 20 to prevent axial movement between the first and second pole sections 10 and 20. Additionally, as also explained in further detail below, a recess defined by the recess surface 146 allows expansion of the locking element 160 when the collar 130 is in the release position to permit axial movement between the first and second pole sections 10 and 20.

The collar 130 may also have a positioning assembly with a positioning element 150 carried in a recess 152, such as a hole. The positioning element 150 may be a ball that is biased against the sleeve 110 by a spring or other biasing element 153 (best shown in FIG. 3A) to press the positioning element 150 into either the first or second depressions 112 or 114 of the sleeve. When the positioning element 150 is in the first depression 112, it holds the collar 130 in the lock position. Conversely, when the positioning element 150 is in the second depression 114, it holds the collar 130 in the release position. Similarly, the first and second depressions 112 and 114 can be formed directly into the outer surface 14 of the first pole section 10, and the positioning element 150 can be biased against the first pole section 10 for retaining the collar 130 in the lock or release position, respectively. The positioning element 150 may also be a resilient retaining ring biased inwardly against the sleeve 110, in which case the recess 152 may be an annular groove configured to receive the ring.

The locking element 160 may be a resilient clip, such as a C-spring or a ring-spring, that is resiliently biased against the outer surface 24 of the second pole section 20. As such, the locking element 160 expands when it is over the outer surface 24 of the second section and contracts to snap into the detents 26 as the second pole section 20 moves axially along the first pole section. As described below, the collar 130, the locking element 160 and the second pole section 20 operate together to fix and release the second pole section 20 to the first pole section 10 at definite lengths. However, if the collar 130 is not in its locked position, the locking element 160 may be removed from each detent 26 by simply applying an axial force between the first pole section 10 and the second pole section 20. Thus, the locking element 160 and the detents 26 releasably fix the position of the first pole section 10 relative to the second pole section 20 at definite locations when the collar 130 is not in its locked position.

Figure 3A:
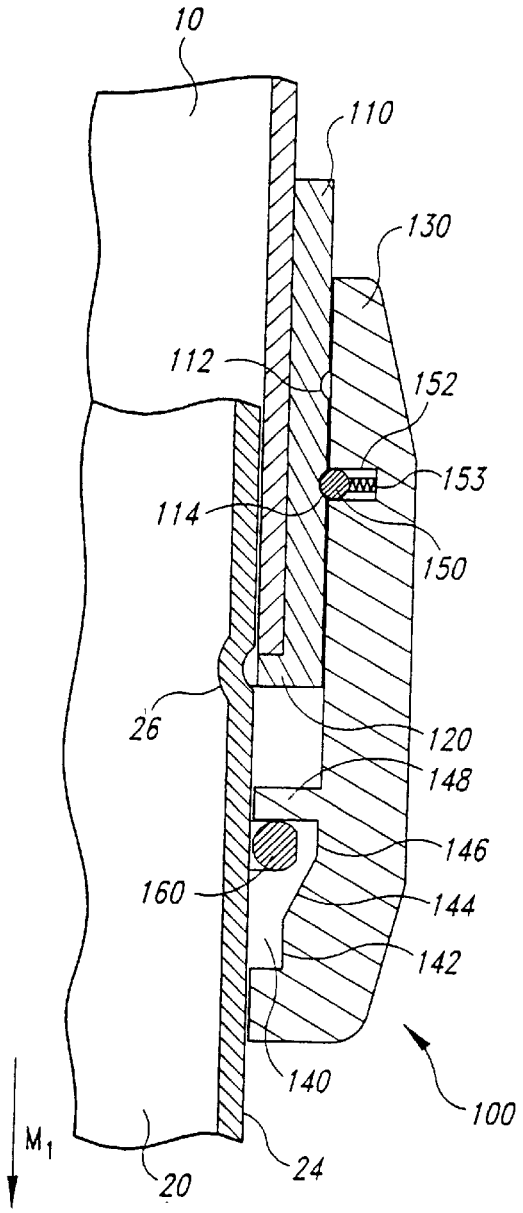
FIG. 3A is a partial cross-sectional view of the first locking assembly of FIG. 2 shown in a release position.
Figure 3B:
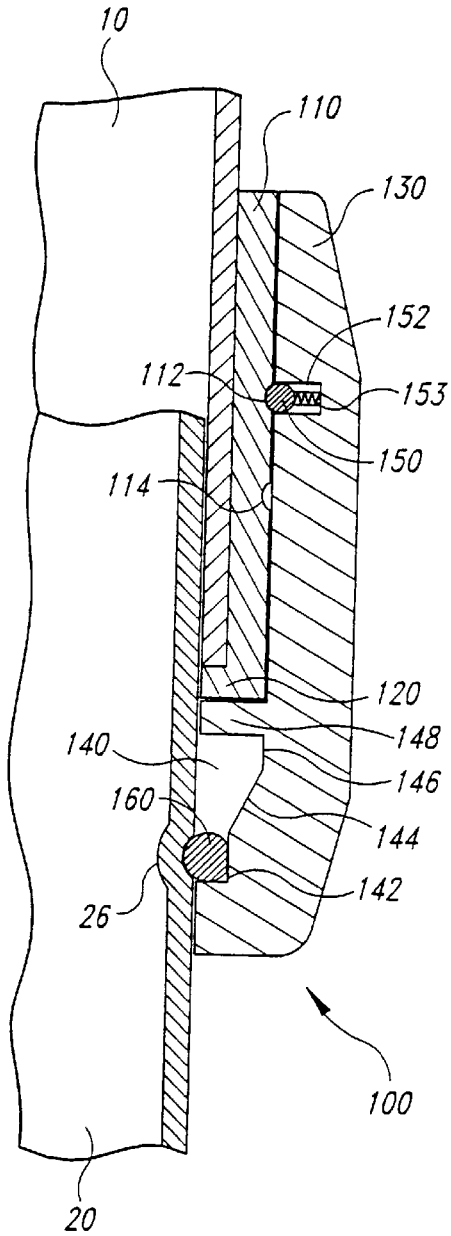
FIG. 3B is a partial cross-sectional view of the first locking assembly of FIG. 2 shown in a lock position.

FIGS. 3A and 3B are partial cross-sectional views illustrating the operation of the first locking assembly 100 to fix and release the second pole section 20 to the first pole section 10. Referring to FIG. 3A, the collar 130 is shown in the release position in which the recessed surface 146 is aligned with the locking element 160. In this collar position, the clearance between the recessed surface 146 and the locking element 160 permits the locking element 160 to expand out of a detent 26 and slide along the outer surface 24 of the second pole section 20. As a result, the second pole section 20 is able to move along the pole axis (arrow $M_1$) until a detent 26 is aligned with the locking element 160. Once a detent 26 is aligned with the locking element 160, the locking element 160 quickly contracts to audibly snap into the detent 26. When the collar 130 is in the release position shown in FIG. 3A, the positioning element 150 is received in the second depression 114 of the sleeve 110 to releasably hold the collar 130 in the release position.

FIG. 3B illustrates the locking assembly 100 after the second pole section 20 has been moved to align one of the detents 26 with the locking element 160, and after the collar 130 has been moved into the lock position. In this position, the collar 130 is positioned so that the retaining surface 142 is aligned with the locking element 160. In this position of the collar 130, there is insufficient clearance between the retaining surface 142 and the locking element 160 to allow expansion of the locking element 160 to the diameter of the outer surface 24 of the second section 20. As a result, the retaining surface 142 prevents the locking element 160 from expanding out of a detent 26 to prevent axial movement between the first and the second pole sections 10 and 20. Additionally, as described in more detail below with reference to FIG. 4, a retaining mechanism may hold the locking element 160 at a fixed axial position so that axial loads applied to the second pole section 20 do not cause the locking element 160 to slide under the recessed surface 146 when the collar 130 is in the lock position. When the collar 130 is in the lock position shown in FIG. 3B, the positioning element 150 is received in the first depression 112 of the sleeve 110 to releasably hold the collar 130 in the lock position.

Figure 4:
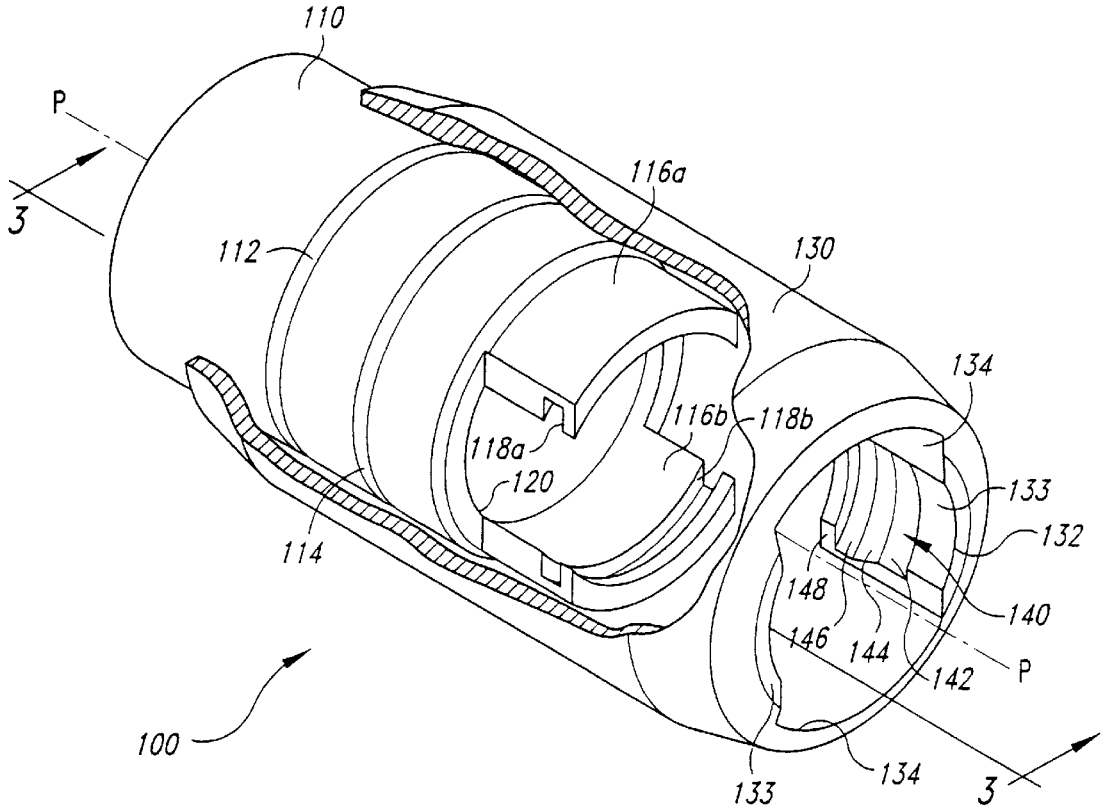
FIG. 4 is an exploded, cut-away isometric view of a portion of a locking assembly in accordance with an embodiment of the invention.

FIG. 4 is an exploded isometric view of a particular embodiment of the sleeve 110 and the collar 130 used in one embodiment of the first locking assembly 100. As discussed above, the sleeve 110 may have an annular first depression 112 and an annular second depression 114 for receiving the positioning element 150 (FIG. 2) of the collar 130. The sleeve 110 may also have opposing retaining flanges 116*a* and 116*b* that have retaining channels 118*a* and 118*b* for holding the locking element 160 (FIG. 2) at a fixed position with respect to the first pole section 10 (FIG. 2). In this particular embodiment of the locking assembly 100, the collar 130 may have an opening 132 defined by two annular portions 133 projecting radially inward toward the pole axis P-P. The annular portions 133 of the collar 130 are spaced apart from one another by opposing axial slots 134 that receive the retaining flanges 116*a* and 116*b* of the sleeve 110 when the collar 130 is fully positioned over the sleeve 110. Accordingly, when the sleeve 110 and the collar 130 are assembled and attached to the first pole section 10, a portion of the cavity 140 in each of the annular portions 133 of the collar 130 is radially aligned with the channels 118*a* and 118*b*. The sleeve 110 and the collar 130 shown in FIG. 4 operate in the same manner discussed above with respect to the locking assembly 100 illustrated in FIGS. 3A and 3B.

Figure 5A:
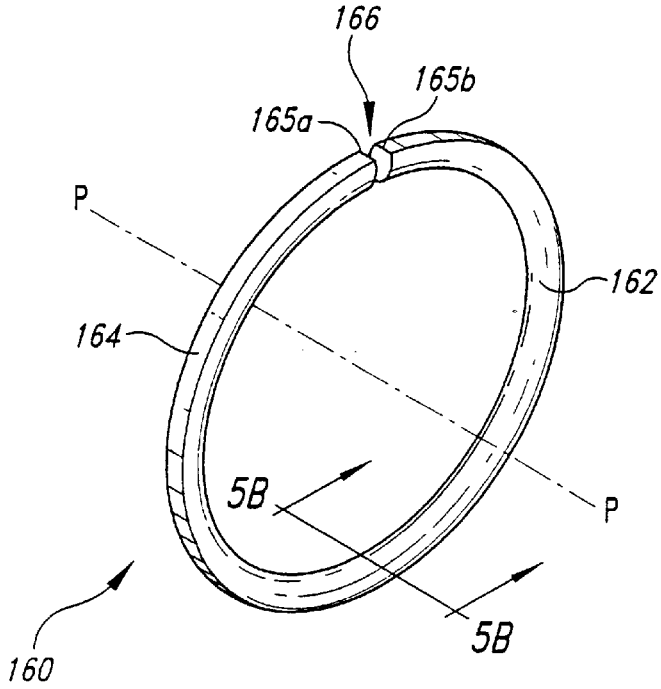
FIG. 5A is an isometric view of a locking element in accordance with an embodiment of the invention.
Figure 5B:
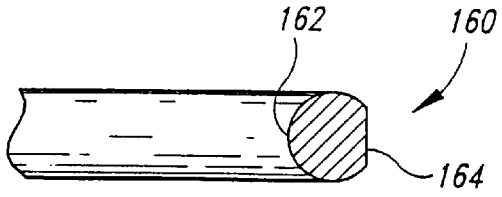
FIG. 5B is a partial cross-sectional view of the locking element of FIG. 5A.

FIG. 5A is an isometric view and FIG. 5B is a partial cross-sectional view of a particular embodiment of a locking element 160 used in one embodiment of the first locking assembly 100. This embodiment of the locking element 160 is a resilient ring-spring that has a curved inner surface 162, a flat outer surface 164, and first and second ends 165*a* and 165*b* spaced apart by a gap 166. The gap 166 between the first and second ends 165*a* and 165*b* may be approximately 0.001–0.050 inches if no means are provided for preventing rotation of the resilient ring. If means are provided for preventing rotation of the resilient ring, then the gap 166 between the first and second ends 165*a* and 165*b* may be approximately 0.002–0.156 inches. The gap 166 is preferably quite narrow to inhibit twisting of the locking element during axial movement between the first and second pole sections 10 and 20, and the gap 166 may be cut diagonally across a portion of the locking element 160. Additionally, as described above, the inner surface 162 is resiliently biased against the outer surface 24 of the second pole section 20 (FIG. 2) so that the resilient locking member 160 snaps into the depressions 26 of the second pole section 20. The inner surface 162 of the locking member 160 may be a smooth, curved surface so that the locking element 160 may be removed from the detents 26 of the second pole section 20 to ride over the outer surface 24 of the second pole section 20 by forcing the second pole section 20 along the pole axis P-P relative to the first pole section 10 when the collar 130 is in the release position. The outer surface 164, on the other hand, is flat to provide more surface area for engaging the retaining surface 142 of the collar 130. Accordingly, the flat outer surface 164 reduces point loads between the locking element 160 and the collar 130 that could dent the retaining surface 142 or otherwise deform the collar 130 in a manner that impairs the positive engagement between the locking element 160 and the detents 26.

In addition to the first locking assembly 100 described above, the second and third pole sections 20 and 30 are coupled together by second locking assembly 200. Referring again to FIG. 2, the second locking assembly 200 has a sleeve 210 fixedly attached to the lower end of the second pole section 20, a collar 230 slidably attached to the sleeve 210, and a second locking element 260 positioned in a cavity 240 of the collar 230. The second locking assembly 200 is similar to the first locking assembly 100, and thus the cavity 240 in the collar 230 is defined by a retaining surface 242 and a recessed surface 246. The collar 230 has a positioning element 250 carried in a recess 252 that is biased radially inwardly by a biasing member 253 (best shown in FIG. 6A) to engage first or second depressions 212 or 214 in the sleeve 210. Additionally, the second locking element 260 may be a resilient ring-spring or other type of clip similar to the first locking element 160 to press against the outer surface 34 and snap into the detents 36 of the third pole section 30.

Figure 6A:
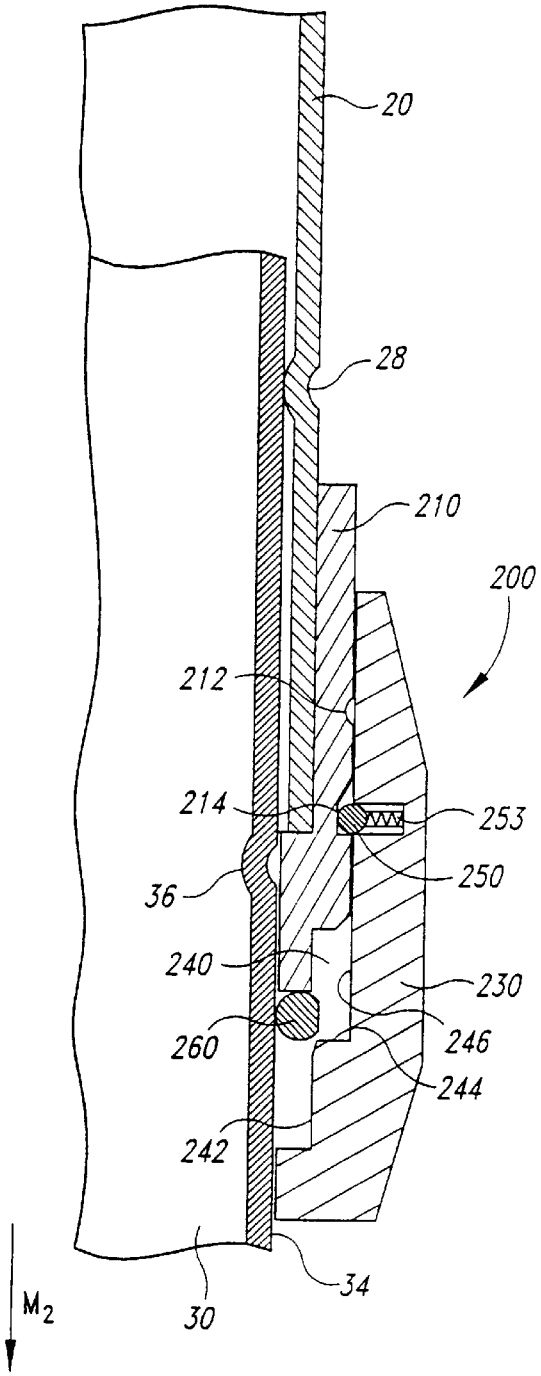
FIG. 6A is a partial cross-sectional view of the second locking assembly of FIG. 2 shown in a release position.
Figure 6B:
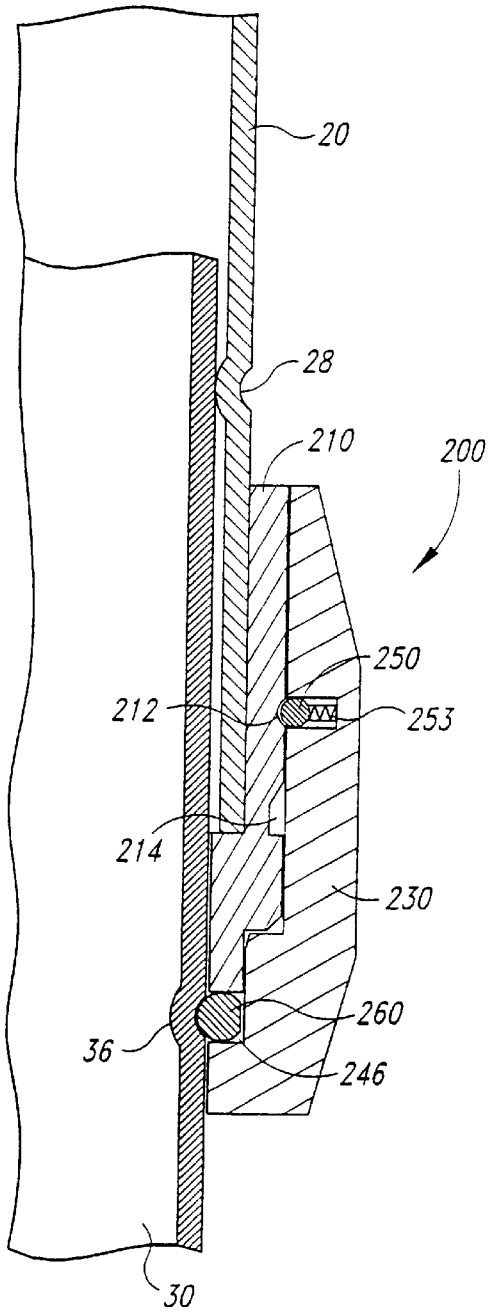
FIG. 6B is a partial cross-sectional view of the second locking assembly of FIG. 2 shown in a closed position.

FIGS. 6A and 6B are partial cross-sectional views illustrating the operation of the second locking element 200 shown in FIG. 2. FIG. 6A illustrates the collar 230 in the release position in which the recessed surface 246 of the collar 230 is aligned with the second resilient locking element 260 to allow the second locking element 260 to ride on the outer surface 34 of the third pole section 30. To extend or contract the third pole section 30 with respect to the second pole section 20, the third pole section 30 is moved axially (arrow $M_2$) until one of the detents 36 is aligned with the second locking element 260. Additionally, as discussed above with respect to the first locking assembly 100, the positioning element 250 engages the second depression 214 in the sleeve 210 to releasably hold the collar 230 in the release position.

FIG. 6B illustrates the second locking assembly 200 after the third pole section 30 has been moved to align one of the detents 36 with the second locking element 260, and the collar 230 has been moved to the lock position. In this position, the retaining surface 242 prevents expansion of the second locking element 260 to prevent axial movement between the second and third pole sections 20 and 30. As discussed above, the positioning element 250 engages the first depression 212 in the sleeve 210 to releasably hold the collar 230 in the lock position.

In operation, the adjustable length sport pole 1 may be quickly positioned at a plurality of definite lengths. Unlike conventional adjustable length sport poles with smooth surfaces and clamp-type or expandable member-type locking assemblies, the sport pole 1 shown in FIG. 1 may be adjusted to a plurality of definite lengths because the first resilient locking member 160 automatically "snaps" into the depressions 26 of the second pole section during adjustment. As such, the first and second pole sections 20 and 30 may be fixed together at predetermined positions to repeatedly adjust the length of the pole 1 to definite, known lengths.

In addition to providing accurate length adjustment of the pole 1, the locking assemblies 100 and 200 prevent the pole sections 10, 20 and 30 from slipping with respect to each other. For example, by preventing the locking clement 160 from disengaging the detents 26 in the second section 20 when the collar 130 is in the lock position, the first and second pole sections 10 and 20 cannot move axially with respect to each other. Thus, unlike the conventional adjustable length poles described above, the pole sections of the adjustable length pole 1 are not subject to slipping with respect to each other. Finally, it is relatively easy to move the collars 130, 230 to the release position to permit the pole to be collapsed or adjusted in length.

From the foregoing it will be appreciated that, although specific embodiments of the invention have been described herein for purposes of illustration, various modifications may be made without deviating from the spirit and scope of the invention. For example, the collars of the locking assemblies may be supported directly on the pole sections so that the locking assemblies do not have sleeves. The collars may also be threadedly attached to either the pole sections or the sleeves to move the collars axially along the pole axis. Additionally, the collar 130 may move rotationally to selectively allow expansion of the locking element in the release position for adjusting the length of the pole. Also, each locking assembly may use multiple locking elements positioned in parallel with each other and adapted to fit into multiple, closely spaced grooves. The invention, therefore, is not limited except as by the appended claims.

We claim:

1. A locking assembly for an adjustable length sport pole that releasably couples first and second pole assemblies together at defined positions along a pole axis to adjust the length of the sport pole, the first pole assembly comprising a first tube and a sleeve coupled thereto, the second pole assembly comprising a second tube and being slidably received within the first pole assembly along the pole axis, and the second pole assembly having an outer surface with a plurality of detents at defined locations, the detents comprising annular grooves around the second tube spaced apart from one another along the pole axis, the locking assembly comprising:

a resilient locking element coupled to the first pole section, the resilient locking element comprising a clip configured to contact and extend around an exterior portion of the second pole section in a plane transverse to the pole axis, the resilient locking element being resiliently biased inwardly against the outer surface of the second pole section so that the resilient locking element is resiliently biased into the detents of the second pole section;

a collar configured to be moveably coupled to the first pole assembly to move between a lock position and a release position, the collar having a cavity in which the resilient locking element is positioned, the cavity being defined by a retaining surface that is aligned with the resilient locking element in the lock position and a recessed surface that is aligned with the resilient locking element in the release position, the retaining surface limiting outward expansion of the resilient locking element when the collar is in the lock position and the resilient locking element is positioned in a detent of the second pole section to prevent the resilient locking element from disengaging from the detent, the recessed surface allowing outward expansion of the resilient locking element when the collar is in the release position to permit the resilient locking element to slide out of the detent and over the outer surface of the second pole section;

a positioning element coupled to the collar and biased against the first pole assembly; and a first depression in the first pole assembly positioned to receive the positioning element in the lock position and a second depression in the first pole assembly positioned to receive the positioning element in the release position, the positioning element being biased against the first pole assembly to engage the first depression and hold the collar in the lock position or to engage the second depression and hold the collar in the release position, and the positioning element being disengageable from the first and second depressions to allow the collar to be manually moved between the lock and release positions.

2. The locking assembly of claim 1 wherein the clip comprises a C-spring with a curved inner surface to fit within the annular grooves of the second tube and a flat outer surface to engage the retaining surface of the collar when the collar is in the lock position.

3. The locking assembly of claim 1 wherein the clip extends around the second tube and has first and second ends spaced apart from one another by approximately 0.001–0.050 inches.

4. The locking assembly of claim 1 wherein the clip extends around the second tube and has first and second ends spaced apart from one another by approximately 0.002–0.156 inches.

5. The locking assembly of claim 1 wherein the collar is threadedly coupled to the first pole assembly.

6. The locking assembly of claim 1, wherein the sleeve is attached to the first tube between the first tube and the collar, the collar slides over the sleeve between the lock position and the release position, and the sleeve has a retaining flange with a channel in which a portion of the resilient locking element is positioned to hold the resilient locking element at a fixed position with respect to the first tube.

7. The locking assembly of claim 6 wherein the collar has an opening to receive the second tube, a slot to receive the flange of the sleeve, and an annular portion having the retaining surface and the recessed surface, the retaining surface being a first annular wall spaced radially outward from the opening with respect to the pole axis and the recessed surface being a second annular wall spaced radially outward from the first annular wall.

8. The locking assembly of claim 7 wherein the clip comprises a C-spring with a curved inner surface to fit within the annular grooves of the second tube and a flat outer surface to engage the retaining surface of the collar when the collar is in the lock position.

9. The locking assembly of claim 7 wherein the clip extends around the second tube and has first and second ends spaced apart from one another by approximately 0.001–0.050 inches.

10. The locking assembly of claim 7 wherein the clip extends around the second tube and has first and second ends spaced apart from one another by approximately 0.002–0.056 inches.

11. The locking assembly of claim 7 wherein:

the positioning element is biased against the sleeve; and the first depression is located on the sleeve to receive the positioning element in the lock position and the second depression is located on the sleeve to receive the positioning element in the release position, the positioning element being engageable with the first depression to hold the collar in the lock position and positioning element being engageable with the second depression to hold the collar in the release position.

12. The locking assembly of claim 1 wherein the collar moves axially with respect to the first pole assembly between the lock and release positions.

13. A connector for releasably attaching a first pole assembly to a second pole assembly in an adjustable length sport pole, the first pole assembly having a first tube and a sleeve coupled thereto and the second pole assembly having a second tube slidably received within the first tube to move along a pole axis, wherein the second tube has an outer surface with a first diameter and a plurality of annular grooves with a second diameter less than the first diameter, the annular grooves being spaced apart from one another along the pole axis, the connector comprising:

a resilient clip coupled to the first tube, the resilient clip being resiliently biased inward against the outer surface of the second tube so that the resilient clip is resiliently biased into the annular grooves of the second tube;

a collar coupled to the first pole assembly to move over the first pole assembly along the pole axis between a fast position and an adjustment position, the collar having an opening with a first radius to receive the second tube and a cavity in which the resilient clip is positioned, the cavity having a retaining surface spaced radially outward from the opening radius and a recessed surface spaced radially outward from the retaining surface, the retaining surface being aligned with the resilient clip in the fast position to hold the resilient clip in one of the annular grooves and prevent axial movement between the first and second tubes, and the recessed surface being aligned with the resilient clip in the adjustment position to permit radial expansion of the resilient clip and allow axial movement between the first and second tubes for adjusting the length of the pole to a defined pole length;

a positioning element coupled to the collar and biased against the first pole assembly; and a first depression in the first pole assembly positioned to receive the positioning element in the lock position and a second depression in the first pole assembly positioned to receive the positioning element in the release position, the positioning element being biased against the first pole assembly to engage the first depression and hold the collar in the lock position or to engage the second depression and hold the collar in the release position, and the positioning element being disengageable from the first and second depressions to allow the collar to be manually movable between the lock and release positions.

14. The connector of claim 13 wherein the clip extends around the second tube and has first and second ends spaced apart from one another by approximately 0.001–0.050 inches.

15. The connector of claim 13 wherein the clip extends around the second tube and has first and second ends spaced apart from one another by approximately 0.002–0.156 inches.

16. The connector of claim 13, wherein the sleeve is attached to the first tube between the first tube and the collar, the collar sliding over the sleeve between the lock position and the release position, and the sleeve having a retaining flange with a channel in which a portion of the clip is positioned to hold the clip at a fixed position with respect to the first tube.

17. The connector of claim 16 wherein the collar has an opening to receive the second tube, a slot to receive the flange of the sleeve, and an annular portion having the retaining surface and the recessed surface, the retaining surface being a first annular wall spaced radially outward from the opening with respect to the pole axis and the recessed surface being a second annular wall spaced radially outward from the first annular wall.

18. The connector of claim 16 wherein the clip extends around the second tube and has first and second ends spaced apart from one another by approximately 0.001–0.050 inches.

19. The connector of claim 16 wherein the clip extends around the second tube and has first and second ends spaced apart from one another by approximately 0.002–0.156 inches.

20. An adjustable length sport pole, comprising:

a first pole assembly having a first tube;

a second pole assembly having a second tube, the second tube, received within the first tube, the second pole assembly sliding with respect to the first pole assembly along a pole axis, and the second tube having an outer surface with a plurality of detents at defined locations, the detents comprising annular grooves around the second tube spaced apart from one another along the pole axis;

a resilient locking element comprising a clip configured to contact and extend around an exterior portion of the second pole section in a plane transverse to the pole axis, the resilient locking element being resiliently biased inward against the outer surface of the second pole section so that the resilient locking element is resiliently biased into the detents of the second pole section;

a collar configured to be moveably coupled to the first pole section to move between a lock position and a release position, the collar having a cavity in which the resilient locking element is positioned, the cavity being defined by a retaining surface that is aligned with the resilient locking element in the lock position and a recessed surface that is aligned with the resilient locking element in the release position, the retaining surface limiting outward expansion of the resilient locking element when the collar is in the lock position and the resilient locking element is positioned in a detent of the second pole section to prevent the resilient locking element from disengaging the detent, the recessed surface allowing outward expansion of the resilient locking element in the release position to permit the resilient locking element to slide out of the detent and over the outer surface of the second pole section;

a positioning element biased against the first pole assembly; and a first depression in the first pole assembly located to receive the positioning element in the lock position and a second depression in the first pole assembly located to receive the positioning element in the release position, the positioning element being biased against the first pole assembly to engage the first depression and hold the collar in the lock position or to engage the second depression and hold the collar in the release position, and the positioning element being disengageable with the first and second depressions to move the collar between the lock and release positions.

21. The sport pole of claim 20 wherein the clip comprises a C-spring with a curved inner surface to fit within the annular grooves of the second tube and a flat outer surface to engage the retaining surface of the collar when the collar is in the lock position.

22. The sport pole of claim 20 wherein the clip extends around the second tube and has first and second ends spaced apart from one another by approximately 0.001–0.050 inches.

23. The sport pole of claim 20, further comprising a sleeve attached to the first pole section between the first pole section and the collar, the collar sliding over the sleeve between the lock position and the release position, and the sleeve having a retaining flange with a channel in which a portion of the locking element is positioned to hold the locking element at a fixed position with respect to the first pole section.

24. The sport pole of claim 23 wherein the collar has an opening to receive the second pole section, a slot to receive the flange of the sleeve, and an annular portion having the retaining surface and the recessed surface, the retaining surface being a first annular wall spaced radially outward from the opening with respect to the pole axis and the recessed surface being a second annular wall spaced radially outward from the first annular wall.

25. The sport pole of claim 24 wherein the clip comprises a C-spring with a curved inner surface to fit within the annular grooves of the second tube and a flat outer surface to engage the retaining surface of the collar when the collar is in the lock position.

26. The sport pole of claim 24 wherein the clip extends around the second tube and has first and second ends spaced apart from one another by approximately 0.001–0.050 inches.

27. The sport pole of claim 24 wherein the clip extends around the second tube and has first and second ends spaced apart from one another by approximately 0.002–0.156 inches.

28. The sport pole of claim 24 wherein:

the collar has a positioning element biased against the sleeve; and the sleeve has a first depression to receive the positioning element in the lock position and a second depression to receive the positioning element in the release position, the positioning element being engageable the first depression to hold the collar in the lock position and positioning element being engageable with the second depression to hold the collar in the release position.

29. The sport pole of claim 20, further comprising:

a third pole assembly received within the second pole assembly, the third pole assembly sliding with respect to the second pole assembly along the pole axis, and the third pole assembly having an outer surface with a detent at an end received within the second pole assembly;

a resilient second locking element configured to contact and extend around an exterior portion of the third pole assembly in a plane transverse to the pole axis, the second locking element being resiliently biased inward against the outer surface of the third pole assembly so that the second locking element is resiliently biased into the detent of the third pole assembly; and a second collar configured to be moveably coupled to the second pole assembly to move between a lock position and a release position, the second collar having a cavity in which the second locking element is positioned, the cavity in the second collar being defined by a second retaining surface and a second recessed surface, the second retaining surface being aligned with the second locking element in the lock position to limit outward expansion of the second locking element when the second locking element is in the detent in the third pole section, and the second recessed surface being aligned with the second locking element in the release position to allow expansion of the second locking element and permit the second locking element to slide out of the detent in the third pole assembly.

30. An adjustable length sport pole, comprising:

a first tube assembly having a first tube and a sleeve coupled thereto;

a second tube slidably received within the first tube to move along a pole axis, the second tube having an outer surface with a first diameter and a plurality of annular grooves with a second diameter less than the first diameter, the annular grooves being spaced apart from one another along the pole axis;

a resilient clip being resiliently biased inward against the outer surface of the second tube so that the resilient clip is resiliently biased into the annular grooves of the second tube;

a collar coupled to the first tube to move over the first tube along the pole axis between a fast position and an adjustment position, the collar having an opening with a first radius to receive the second tube and a cavity in which the resilient clip is positioned, the cavity having a retaining surface spaced radially outward from the opening radius and a recessed surface spaced radially outward from the retaining surface, the retaining surface being aligned with the resilient clip in the fast position to hold the resilient clip in one of the annular grooves and prevent axial movement between the first and second tubes, and the recessed surface being aligned with the resilient clip in the adjustment position to permit radial expansion of the resilient clip and allow axial movement between the first and second tubes for adjusting the length of the pole to a defined pole length;

a positioning element biased against the first tube assembly; and a first depression in the first tube assembly to receive the positioning element in the lock position and a second depression in the first tube assembly to receive the positioning element in the release position, the positioning element being biased against the first tube assembly to engage the first depression and hold the collar in the lock position or to engage the second depression and hold the collar in the release position, and the positioning element being disengageable with the first and second depressions to move the collar between the lock and release positions.

31. The sport pole of claim 30 wherein the clip extends around the second tube and has first and second ends spaced apart from one another by approximately 0.001–0.050 inches.

32. The port pole of claim 30 wherein the clip extends around the second tube and has first and second ends spaced apart from one another by approximately 0.002–0.156 inches.

33. The sport pole of claim 30, further comprising a sleeve attached to the first tube between the first tube and the collar, the collar sliding over the sleeve between the lock position and the release position, and the sleeve having a retaining flange with a channel in which a portion of the clip is positioned to hold the clip at a fixed position with respect to the first tube.

34. The sport pole of claim 33 wherein the collar has an opening to receive the second tube, slot to receive the flange of the sleeve, and an annular portion having the retaining surface and the recessed surface, the retaining surface being first annular wall spaced radially outward from the opening with respect to the pole axis and the recessed surface being a second annular wall spaced radially outward from the first annular wall.

35. The sport pole of claim 34 wherein the clip extends around the second tube and has first and second ends spaced apart from one another by approximately 0.001–0.050 inches.

36. The sport pole of claim 34 wherein the clip extends around the second tube and has first and second ends spaced apart from one another by approximately 0.002–0.156 inches.

37. A locking assembly for releasably coupling first and second pole assemblies together in at least one defined position along a pole axis, the first pole assembly having a first tube and a sleeve coupled thereto, the second pole being slidably received within the first pole assembly along the pole axis, the second pole assembly having a second tube and an outer surface with a detent at a defined location the detent comprising an annular groove around the second tube, the locking assembly comprising:

a resilient locking element fixedly coupled to the sleeve, the sleeve having a retaining flange with a channel in which a portion of the resilient locking element is positioned to hold the resilient locking element at a fixed position with respect to the first pole section, the resilient locking element having a clip configured to contact and extend around an exterior portion of the second pole assembly in a plane transverse to the pole axis, the resilient locking element being resiliently biased inwardly against the outer surface of the second pole assembly so that the resilient locking element is resiliently biased into the detent of the second pole assembly;

a collar configured to be moveably coupled to the first pole assembly to move between a lock position and a release position, the collar having a cavity in which the resilient locking element is positioned, the cavity being defined by a retaining surface that is aligned with the resilient locking element in the lock position and a recessed surface that is aligned with the resilient locking element in the release position, the retaining surface limiting outward expansion of the resilient locking element when the collar is in the lock position and the resilient locking element is positioned in a detent of the second pole section to prevent the resilient locking element from disengaging the detent, the recessed surface allowing outward expansion of the resilient locking element when the collar is in the release position to permit the resilient locking element to slide out of the detent and over the outer surface of the second pole assembly.

38. The locking assembly of claim 37 wherein the adjustable length pole comprises a sport pole.

39. The locking assembly of claim 37 wherein a plurality of the detents are formed in the second pole section at spaced apart locations so that the first and second pole sections are adjustable to a plurality of lengths between expanded and collapsed lengths.

40. The locking assembly of claim 37 wherein the clip comprises a C-spring with a curved inner surface to fit within the annular groove of the second tube and a flat outer surface to engage the retaining surface of the collar when the collar is in the lock position.

41. The locking assembly of claim 37 wherein the clip extends around the second tube and has first and second ends spaced apart from one another by approximately 0.001–0.050 inches.

42. The locking assembly of claim 37 wherein the clip extends around the second tube and has first and second ends spaced apart from one another by approximately 0.002–0.156 inches.

43. The locking assembly of claim 37 wherein:

the collar has a positioning element biased against the first pole assembly; and the first pole assembly has a first depression to receive the positioning element in the lock position and a second depression to receive the positioning element in the release position, the positioning element being biased against the first pole assembly to engage the first depression and hold the collar in the lock position or to engage the second depression and hold the collar in the release position, and the positioning element being disengageable with the first and second depressions to move the collar between the lock and release positions.

44. The locking assembly of claim 37 wherein the collar is threadedly coupled to the first pole assembly.

45. The locking assembly of claim 37, further comprising a sleeve attached to the first pole between the first pole section and the collar, the collar sliding over the sleeve between the lock position and the release position, and the sleeve having a retaining flange with a channel in which a portion of the locking element is positioned to hold the locking element at a fixed position with respect to the first pole section.

46. The locking assembly of claim 45 wherein the collar has an opening to receive the second pole section, a slot to receive the flange of the sleeve, and an annular portion having the retaining surface and the recessed surface, the retaining surface being a first annular wall spaced radially outward from the opening with respect to the pole axis and the recessed surface being a second annular wall spaced radially outward from the first annular wall.

47. The locking assembly of claim 45 wherein the clip comprises a C-spring with a curved inner surface to fit within the annular groove of the second tube and a flat outer surface to engage the retaining surface of the collar when the collar is in the lock position.

48. The locking assembly of claim 45 wherein the clip extends around the second tube and has first and second ends spaced apart from one another by approximately 0.001–0.050 inches.

49. The locking assembly of claim 45 wherein the clip extends around the second tube and has first and second ends spaced apart from one another by approximately 0.002–0.144 inches.

50. The locking assembly of claim 45 wherein:

the positioning element is biased against the sleeve; and the first depression is located in the sleeve and positioned to receive the positioning element in the lock position and the second depression is located in the sleeve and positioned to receive the positioning element in the release position, the positioning element being engageable with the first depression to hold the collar in the lock position and the positioning element being engageable with the second depression to hold the collar in the release position.

51. The locking assembly of claim 37 wherein the collar moves axially with respect to the first pole section between the lock and release positions.

52. A locking assembly for an adjustable length sport pole that releasably couples first and second pole assemblies together at defined positions along a pole axis to adjust the length of the sport pole, the first pole assembly comprising a first tube and a sleeve coupled thereto, the second pole assembly comprising a second tube and being slidably received within the first pole assembly along the pole axis, and the second pole assembly having an outer surface with a plurality of detents at defined locations, the detents comprising annular grooves around the second tube spaced apart from one another along the pole axis, the locking assembly comprising:

a resilient locking element coupled to the first pole section, the resilient locking element comprising a clip configured to contact and extend around an exterior portion of the second pole section in a plane transverse to the pole axis, the resilient locking element being resiliently biased inwardly against the outer surface of the second pole section so that the resilient locking element is resiliently biased into the detents of the second pole section;

a collar configured to be moveably coupled to the first pole assembly to slide axially with respect to the first pole assembly between a lock position and a release position, the collar having a cavity in which the resilient locking element is positioned, the cavity being defined by a retaining surface that is aligned with the resilient locking element in the lock position and a recessed surface that is aligned with the resilient locking element in the release position, the retaining surface limiting outward expansion of the resilient locking element when the collar is in the lock position and the resilient locking element is positioned in a detent of the second pole section to prevent the resilient locking element from disengaging from the detent, the recessed surface allowing outward expansion of the resilient locking element when the collar is in the release position to permit the resilient locking element to slide out of the detent and over the outer surface of the second pole section;

a positioning element coupled to the collar and biased against the first pole assembly; and a first depression in the first pole assembly positioned to receive the positioning element in the lock position and a second depression in the first pole assembly positioned to receive the positioning element in the release position.

53. A locking assembly for releasably coupling first and second pole assemblies together in at least one defined position along a pole axis, the first pole assembly having a first tube and a sleeve coupled thereto, the second pole being slidably received within the first pole assembly along the pole axis, the second pole assembly having a second tube and an outer surface with a detent at a defined location the detent comprising an annular groove around the second tube, the locking assembly comprising:

a resilient locking element fixedly coupled to the sleeve, the sleeve having a retaining flange with a channel in which a portion of the resilient locking element is positioned to hold the resilient locking element at a fixed position with respect to the first pole section the resilient locking element having a clip configured to contact and extend around an exterior portion of the second pole assembly in a plane transverse to the pole axis, the resilient locking element being resiliently biased inwardly against the outer surface of the second pole assembly so that the resilient locking element is resiliently biased into the detent of the second pole assembly;

a collar configured to be moveably coupled to the first pole assembly to slide axially with respect to the first pole assembly between a lock position and a release position, the collar having a cavity in which the resilient locking element is positioned, the cavity being defined by a retaining surface that is aligned with the resilient locking element in the lock position and a recessed surface that is aligned with the resilient locking element in the release position, the retaining surface limiting outward expansion of the resilient locking element when the collar is in the lock position and the resilient locking element is positioned in a detent of the second pole section to prevent the resilient locking element from disengaging the detent, the recessed surface allowing outward expansion of the resilient locking element when the collar is in the release position to permit the resilient locking element to slide out of the detent and over the outer surface of the second pole assembly;

a positioning element coupled to the collar and biased against the first pole assembly; and a first depression in the first pole assembly located to receive the positioning element in the lock position and a second depression in the first pole assembly located to receive the positioning element in the release position.

* * * * *

UNITED STATES PATENT AND TRADEMARK OFFICE

CERTIFICATE OF CORRECTION

PATENT NO. : 6,354,629 B1 
DATED : March 12, 2002
INVENTOR(S) : Joseph R. McNeal, Michael K. Reeves and Aaron K. Taylor It is certified that error appears in the above-identified patent and that said Letters Patent is hereby corrected as shown below:

Column 13,
Line 34, reads “port” should read -- sport --

Column 15,
Line 27, reads “0.144” should read -- 0.156 --

Signed and Sealed this

Twenty-fourth Day of September, 2002

*Attest:*

*Attesting Officer*

JAMES E. ROGAN
*Director of the United States Patent and Trademark Office*